US007930912B2

(12) United States Patent
Lee et al.

(10) Patent No.: US 7,930,912 B2
(45) Date of Patent: Apr. 26, 2011

(54) WASHING MACHINE

(75) Inventors: Kyu Hwan Lee, Changwon-Si (KR); Hee Tae Lim, Changwon-Si (KR); Jae Hyun Choi, Changwon-Si (KR); Ig Geun Kwon, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 425 days.

(21) Appl. No.: 12/081,038

(22) Filed: Apr. 9, 2008

(65) Prior Publication Data

US 2009/0071202 A1 Mar. 19, 2009

(30) Foreign Application Priority Data

Apr. 10, 2007 (KR) ..... 10-2007-0034992

(51) Int. Cl.
*D06F 37/06* (2006.01)

(52) U.S. Cl. ..... 68/212

(58) Field of Classification Search ..... 68/212
See application file for complete search history.

(56) References Cited

U.S. PATENT DOCUMENTS

| | | | | |
|---|---|---|---|---|
| 3,726,114 | A * | 4/1973 | Ahmad | 68/134 |
| 2002/0083743 | A1 | 7/2002 | Uszkureit | |
| 2003/0074932 | A1 * | 4/2003 | No et al. | 68/58 |
| 2004/0123634 | A1 * | 7/2004 | Kim et al. | 68/24 |

* cited by examiner

*Primary Examiner* — Michael Barr
*Assistant Examiner* — Samuel A Waldbaum
(74) *Attorney, Agent, or Firm* — McKenna Long & Aldridge LLP

(57) ABSTRACT

A washing machine having a lifter is disclosed. The washing machine comprises a housing; a tub provided in the housing and holding washing water therein; a drum rotatably mounted in the tub and receiving laundry therein; and a lifter mounted to an inner surface of the drum to lift the laundry while rotating along with the drum, wherein the lifter is formed to have a nonlinear shape, and wherein the lifter is oriented such that a centerline thereof forms a predetermined angle with respect to a rotational axis of the drum.

25 Claims, 6 Drawing Sheets

WASHING MACHINE

This application claims the benefit of the Korean Patent Application No. 10-2007-0034992, filed on Apr. 10, 2007, which is hereby incorporated by reference as if fully set forth herein.

BACKGROUND OF THE INVENTION

1. Field of the Invention

The present invention relates to a washing machine, and more particularly, to a lifter installed in a washing machine.

2. Discussion of the Related Art

In general, a washing machine refers to an appliance that washes laundry using detergent and mechanical friction. Among the washing machines, especially a front loading washing machine is more advantageous in view of a compact size and less damage to the laundry, and therefore is widely used nowadays.

Such a front loading washing machine comprises a housing, a tub mounted inside the housing, and a drum rotatably installed in the tub. In the drum, a lifter is provided to lift laundry being washed so that the laundry drops from a predetermined height. However, since it is general that the lifter has a linear structure, lifting of the laundry could not be successfully performed and a flow of washing water could not be actively and smoothly formed in the drum.

SUMMARY OF THE INVENTION

Accordingly, the present invention is directed to a washing machine having a lifter that substantially obviates one or more problems due to limitations and disadvantages of the related art.

An object of the present invention is to provide a washing machine having a lifter, capable of efficiently lifting laundry being washed and promoting a circulation and a flow of washing water in a drum mounted therein.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine comprises a housing; a tub provided in the housing and holding washing water therein; a drum rotatably mounted in the tub and receiving laundry therein; and a lifter mounted to an inner surface of the drum to lift the laundry while rotating along with the drum, wherein the lifter is formed to have a nonlinear shape, and wherein the lifter is oriented such that a centerline thereof forms a predetermined angle with respect to a rotational axis of the drum.

The centerline of the lifter may be pivoted about a center point of the lifter by the predetermined angle from the rotational axis of the drum.

The lifter may have a streamline shape. Lateral portions of the lifter may be partially bulged. Bulged portions of the lifter may each comprise a curved surface entirely. Here, a section of the bulged portion of the lifter may be formed as an airfoil shape.

The shape of the lifter may be symmetrical about the center point. One lateral portion of the lifter has a reversed shape to the other lateral side.

The lifter may comprise a lifter body, and first and second protrusions bulged outwardly on the left and right sides of the lifter body. The first and the second protrusions may each have a curved surface entirely. Each of section of the first and the second protrusions may be formed as an airfoil shape.

The first and the second protrusions are arranged alternatively on the lateral portions of the lifter body. The first and the second protrusions may be symmetrical with respect to the center point.

The first and the second protrusions may each have a plurality of dimples or a plurality of protrusions.

The lifter may comprise a guide surface disposed adjacent to each upper part of the first and the second protrusions and inclined toward an inside of the lifter. The guide surface may be continuously formed from each upper edge of the first and the second protrusions. The lifter may further comprise a channel formed adjacent to the each upper part of the first and the second protrusions to guide the washing water.

The lifter may comprise a plurality of coupling parts disposed at a lower end thereof for engagement with the drum, and the coupling parts are oriented all in different directions. Each of the coupling parts has the same orientation as an adjacent outer profile of the lifter.

According to the embodiment of the present invention, the laundry can be effectively lifted to a predetermined height, and the washing water could be actively and smoothly circulated and flowed in the drum. As a result, the washing performance will be highly improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, an example of which is illustrated in the accompanying drawings. Wherever possible, the same reference numbers will be used throughout the drawings to refer to the same or like parts.

Although a washing machine performing only a washing function is explained in the following description, this description is made only by way of example and not as a limitation to the scope of our invention. Therefore, the same concept and features of the invention can be applied to a washing machine performing both drying and washing.

Figure 1:
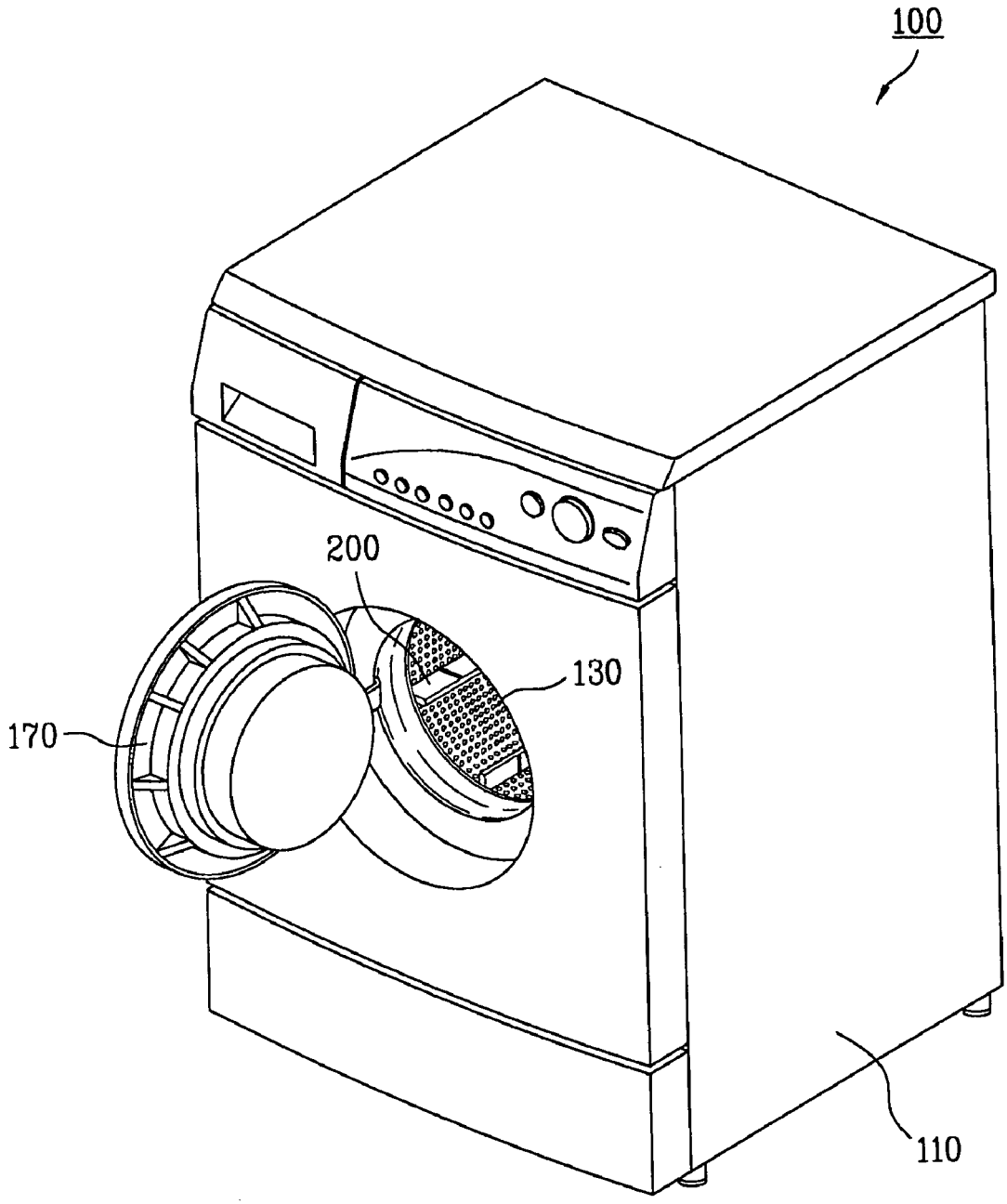
FIG. 1 is a perspective view of a washing machine according to an embodiment of the present invention.
Figure 2:
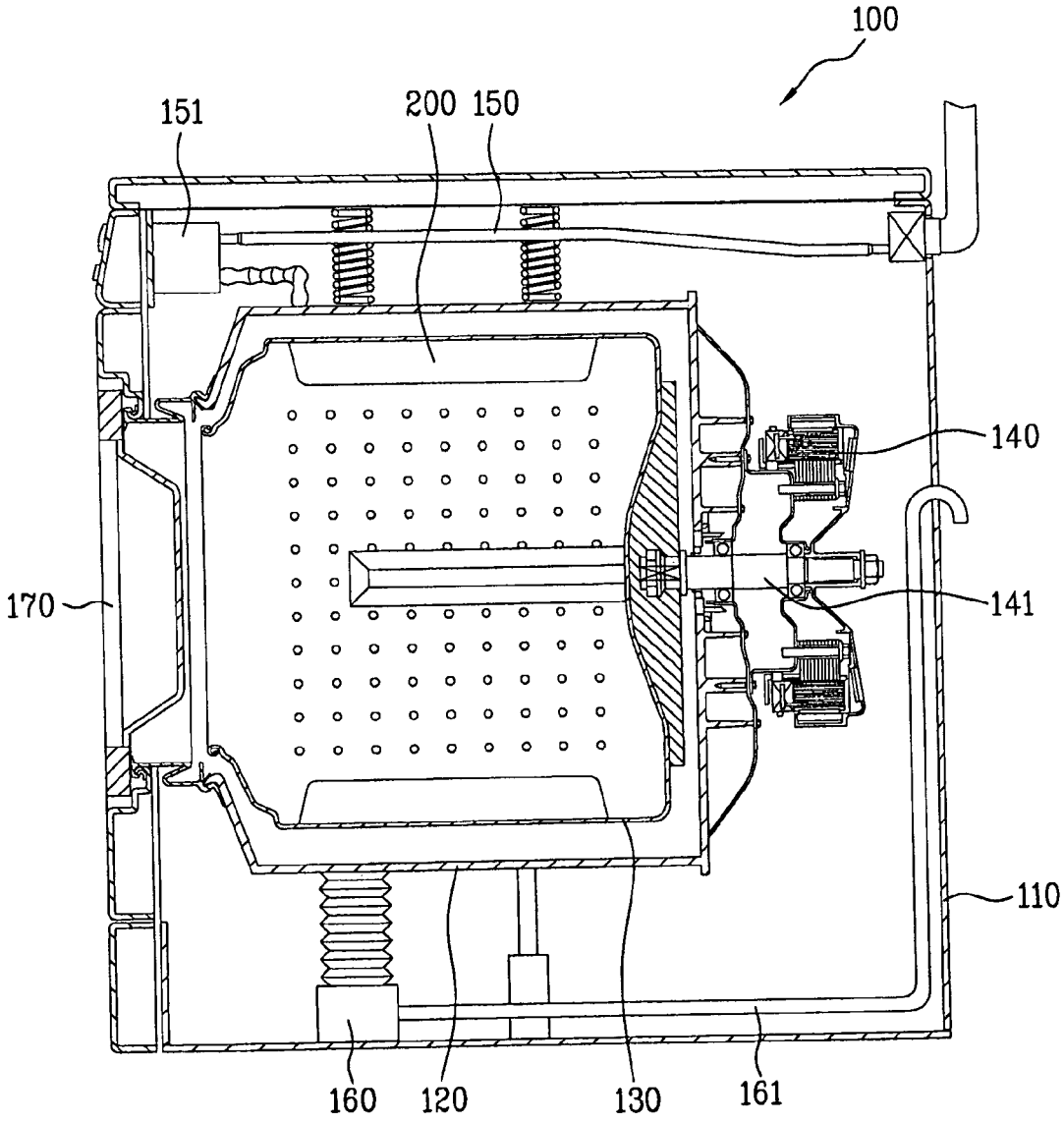
FIG. 2 is a side-sectional view of the washing machine according to the embodiment of the present invention.

FIGS. 1 and 2 are a perspective view and a side sectional view, respectively, of a washing machine according to an embodiment of the present invention.

Referring to these drawings, the washing machine 100 according to the embodiment of the present invention comprises a housing 110 constituting the exterior appearance and having an opening for putting laundry to be washed into the washing machine, a door 170 opening and closing the opening, a tub 120 mounted within the housing 110 to hold therein wash water, a drum 130 rotatably mounted in the tub 120 and forming a space for washing the laundry received through the opening, and at least one lifter 200 mounted to the drum 130 to lift the laundry to a predetermined height so that the laundry could fall off at such a height in the drum.

In addition, the washing machine 100 further comprises a driving unit 140 for rotating the drum 130, a rotating shaft 141 for transmitting a rotating force of the driving unit 140 to the drum 130, a water supply pipe 150 and a detergent supplying device 151 for supplying the wash water and detergent to the tub 120 respectively, and a drain pump 160 and a drain pipe 161 for discharging the wash water stored in the tub 120 to the outside of the housing 110.

The lifter 200 is mounted to an inner surface of the drum 130 to protrude inwardly. Accordingly, the lifter 200 lifts the laundry up to the predetermined height in the drum 130 while rotating along with the drum 130 and also circulates the washing water in the drum 130. As shown in FIG. 1, the lifter 200 usually has a linear structure. However, as aforementioned, such a linearly structured lifter 200 is limited in accomplishing a desired lifting performance. To this end, the lifter 200 according to the embodiment of the present invention is configured to improve the laundry lifting performance, as will be described in greater detail hereinafter.

Figure 3:
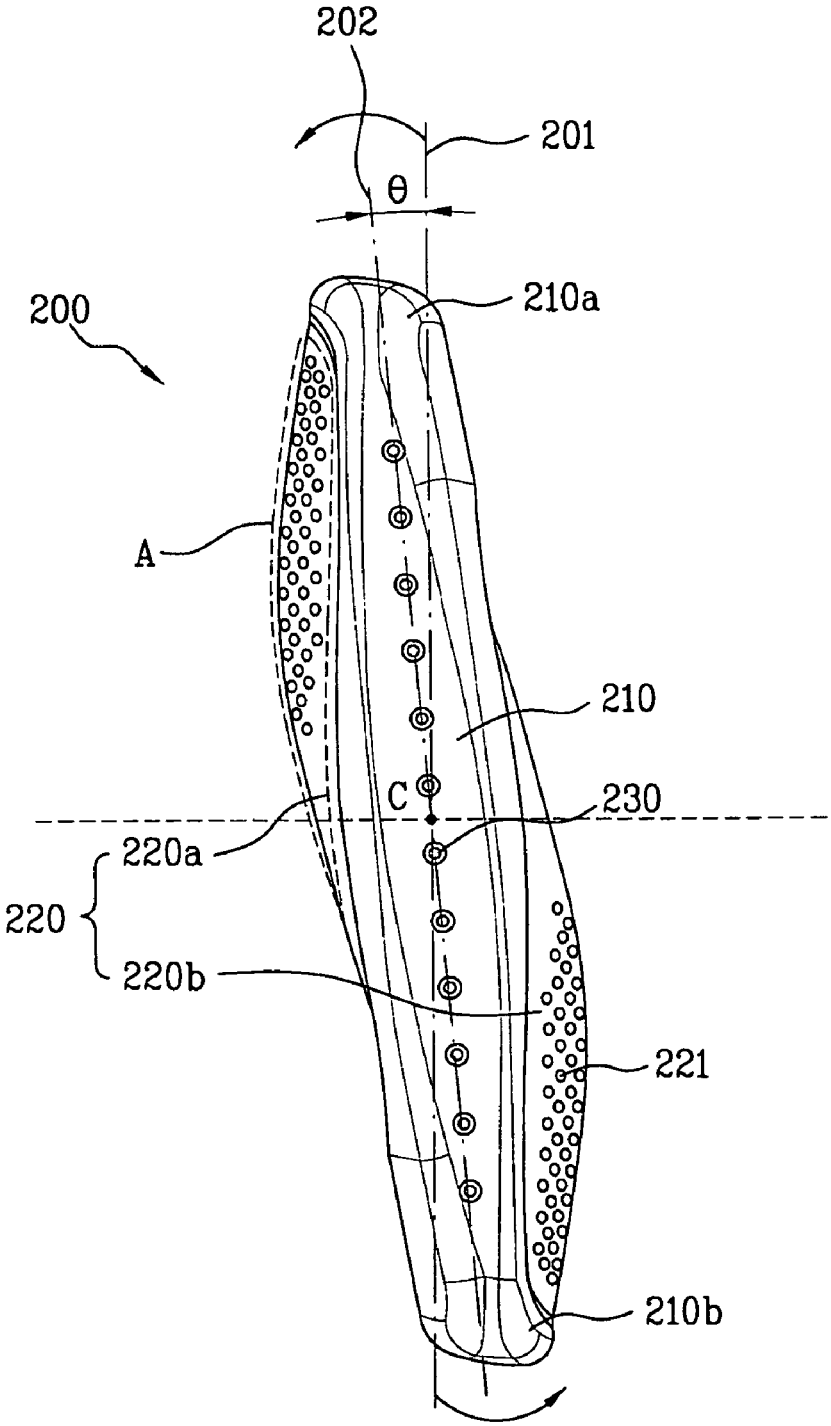
FIG. 3 is a plan view of a lifter of the washing machine according to the embodiment of the present invention.
Figure 4A:
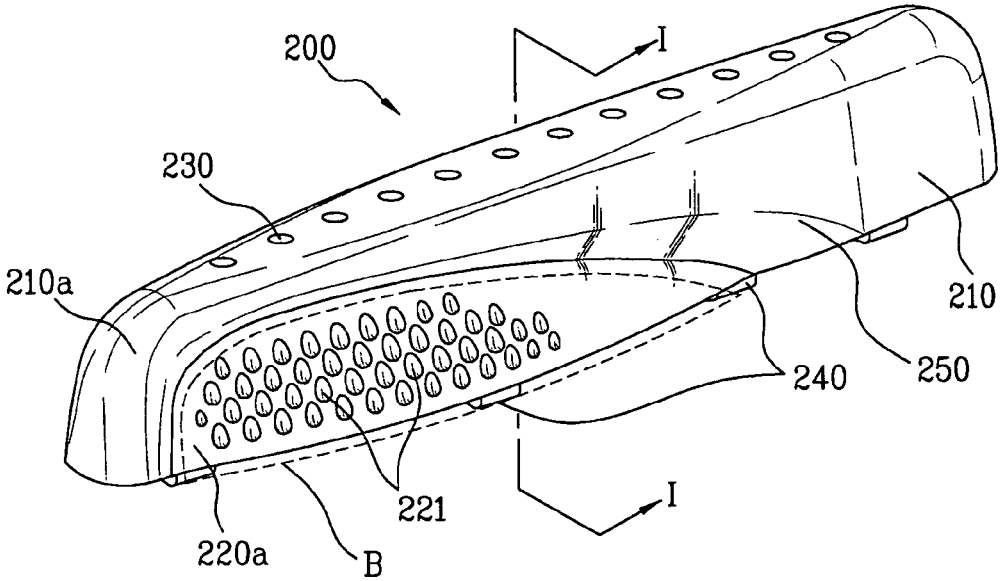
FIG. 4A is a perspective view of the lifter according to the embodiment of the present invention.
Figure 4B:
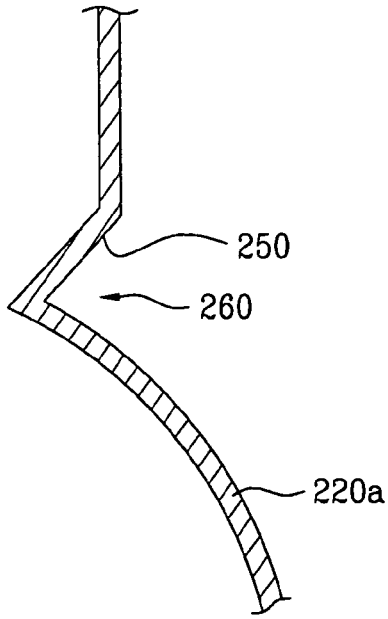
FIG. 4B is a sectional view taken along a line I-I of FIG. 4A.
Figure 5:
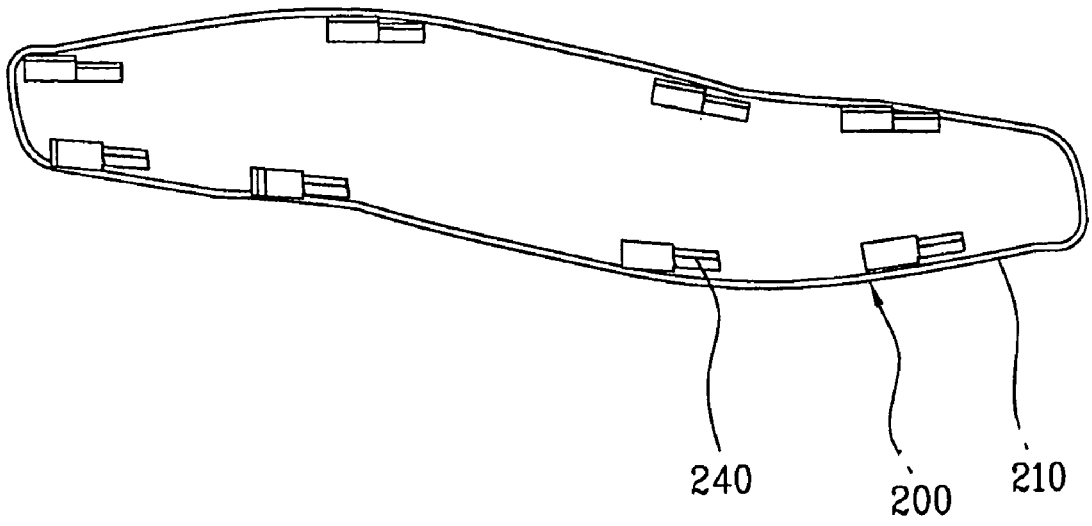
FIG. 5 is a plan view showing a bottom of the lifter.

FIG. 3 is a plan view of the improved lifter according to the embodiment of the present invention. FIG. 4A is a perspective view of the lifter, and FIG. 4B is a sectional view taken along a line I-I of FIG. 4A. FIG. 5 is a plan view showing a bottom of the lifter.

Referring to FIG. 3, a centerline 202 of the lifter 200, which passes through the centers of both ends 210*a* and 210*b* of the lifter 200, is oriented to have a predetermined angle θ with respect to a rotational axis 201 of the drum 130. More specifically, as indicated by arrows, the centerline 202 is pivoted by the predetermined angle θ from the rotational axis 201 about a center C of the lifter 200. That is, the lifter 200 is oriented to be inclined with respect to the rotational axis 201 as a whole.

In comparison with the conventional linear orientation, such an inclined orientation of the lifter 200 is efficient in generating more active and irregular flows of the washing water at the both ends 210*a* and 210*b*. To be more particular, lateral sides of the conventional linear lifter are substantially parallel with the rotational axis 201. Therefore, when the drum 130 is rotating, those lateral sides contact the washing water uniformly. In contrast, lateral sides of the lifter 200 according to this embodiment are relatively protruded outwardly around the both ends 210*a* and 210*b* due to the inclined orientation. The protruded lateral sides induce the more active and irregular flows of the washing water by a non-uniform contact with the washing water. Through the active and rough flows, the laundry can be more frequently rubbed with the lifter 200 and the inner surface of the drum 130. As a consequence, washing performance can be improved. Also, since the protruded lateral sides at the both ends 210*a* and 210*b* actually expand a frictional surface area, the washing performance can be further improved.

Additionally, the lifter 200 is configured to have various curved surfaces in order to generate more active and smooth circulation and flow of the washing water therearound. That is, the lifter 200 could have a nonlinear shape, preferably, a streamline shape. More specifically, as denoted by a reference numeral 220 in the drawings, the lateral portions of the lifter 200 are partially bulged to thereby form a substantially large curved surface at least. These bulged parts will now be described in greater detail with reference to FIGS. 3 and 4.

As shown in FIG. 3, the lifter 200 includes a lifter body 210 and first and second protrusions 220*a* and 220*b* respectively formed on left and right sides of the lifter body 210. As described above, the centerline 202 of the lifter body 210 is oriented to have the angle θ with respect to the rotational axis 201 of the drum 130. In other words, the centerline 202 is inclined by the predetermined angle θ with respect to the rotational axis 201. In addition, the first and the second protrusions 220*a* and 220*b* are bulged outwardly on the left and right sides of the lifter body 210, respectively.

As illustrated in the drawings, each of the first and the second protrusions 220*a* and 220*b* comprises a curved surface entirely. More specifically, as indicated by a dotted line in FIG. 3, a horizontal section A of the first and the second protrusions 220*a* and 220*b* is in the form of an airfoil which is advantageous for a flow of fluid therearound. As indicated by a dotted line in FIG. 4A, a vertical section B of the first and the second protrusions 220*a* and 220*b* also has the airfoil shape. Accordingly, as evident from these sectional shapes A and B, the first and second protrusions 220*a* and 220*b* allow the lifter 200 to substantially have a nonlinear and streamline shape, which promotes the circulation and flow of the washing water. Moreover, since the first and the second protrusions 220*a* and 220*b* help the laundry to be more securely caught by the lifter 200, the laundry could be prevented from dropping from the lifter 200 in advance while being lifted by the lifter 200. Thus, the laundry could fall off from the predetermined height as desired and accordingly the washing performance could be greatly enhanced.

In order to further promote the flow and circulation of the washing water, preferably, the first and the second protrusions 220*a* and 220*b* are alternately arranged on the lateral portions (i.e. left and right sides) of the lifter 200 as shown in FIG. 3. For the same reason, it is also advantageous that the first and the second protrusions 220*a* and 220*b* are in reversed shapes to each other with respect to the centerline 202. More specifically, the first protrusion 220*a* is extended from the first end 210*a* toward the second end 210*b* disposed opposite to the first end 210*a* whereas the second protrusion 220*b* is extended from the second end 210*b* toward the first end 210*a*. In addition, both the first and the second protrusions 220*a* and 220*b* are extended substantially up to the middle of the lifter body 210 of the lifter 200. As a result, the lifter 200 has such a configuration in which one lateral portion has the reversed shape to the other lateral portion. That is, the liter 200 has configurations or shapes which are reverse to each other with respect to the center line 202, In brief, the shape of the lifter 200 is symmetrical about the center C or is in a point symmetry with regard to the center C. This structural characteristic of the lifter 200 enhances the active and smooth circulation and flow of the washing water around the lifter 200 during washing.

Additionally, a plurality of dimples 221 could be further formed at the protrusion 220 (i.e. the first and second protrusions 220*a* and 2200*b*). As the wash water whirls within the dimples 221, a plurality of small vortexes are generated. Owing to the small vortexes, the flow of washing water is made irregular and as a result, the washing performance is enhanced. Alternatively, in stead of the dimples 221, a plurality of small protrusions could be formed at the protrusions 220. In this case, the laundry could be lifted to a desired height more efficiently without slipping out of the lifter 200 by being caught by the protrusions.

With reference to FIGS. 4A and 4B, the lifter 200 further includes guide surfaces 250 formed adjacent to each upper part of the first and the second protrusions 220*a* and 220*b*. Each guide surface 250 is inclined toward an inside of the lifter body 210 to guide the flow of washing water. More particularly, the guide surface 250 could be continuously formed from each upper edge of the first and the second protrusions 220*a* and 220*b*, and also could extend along the entire upper edge. As shown in greater detain in FIG. 4B, the guide surface 250 constitutes a channel 260 along with each outer surface of the protrusions 220*a* and 220*b*. The channel 260 serves as a guiding path for the washing water such that the wash water could smoothly flows along the lateral portions of the lifter 200. Since both the guide surfaces 250 and the channels 260 are formed adjacent to and continuous from the protrusions 220, these guide surfaces 250, the channel 260, and the protrusions 220 could help one another to greatly enhance the smooth flow and circulation of the washing water around the lifter 200.

Meanwhile, as shown in FIG. 5, a plurality of coupling parts 240 are formed at a lower end of the lifter 200. The coupling parts 240 are engaged with the drum 130, and thereby mount the lifter 200 to the drum 130. According to the exemplary embodiment, each of the coupling parts 240 has the same orientation as an outer profile of the lifter 200 adjacent thereto. The entire outer profile of the lifter 200 is nonlinear as already described and, more specifically, streamlined. Therefore, as being oriented in the same directions as respective adjacent portions of the outer profile, the coupling parts 240 are arranged not linearly but all in different directions. Also, the drum 130 has holes for receiving the coupling parts 240 and these holes should be aligned for proper coupling with the coupling parts 240. Therefore, the holes are arranged all in different directions to respectively have the same orientations as corresponding coupling parts 240. For these reasons, by engaging the coupling parts 240 with the corresponding holes, respectively, the lifter 200 can be mounted to the drum 130 maintaining its correct orientation. In a case where the coupling part 240 is implemented by a hook, which needs no additional fastening member to mount the lifter 200 to the drum 130, it requires less force to engage the hooks with the holes, due to their different orientations. Therefore, the lifter 200 could be more conveniently mounted to the drum 130.

Moreover, a plurality of drain holes 230 are formed on an upper end of the lifter body 210. The drain holes 230 guide the wash water flowed into the lifter 200 to be discharged back to the inside of the drum 130. Preferably, the drain holes 230 are arranged along the centerline 202 of the lifter 200. The washing water in the lifter 200 could be effectively drained through the drain holes 230 arranged as such.

Figure 6:
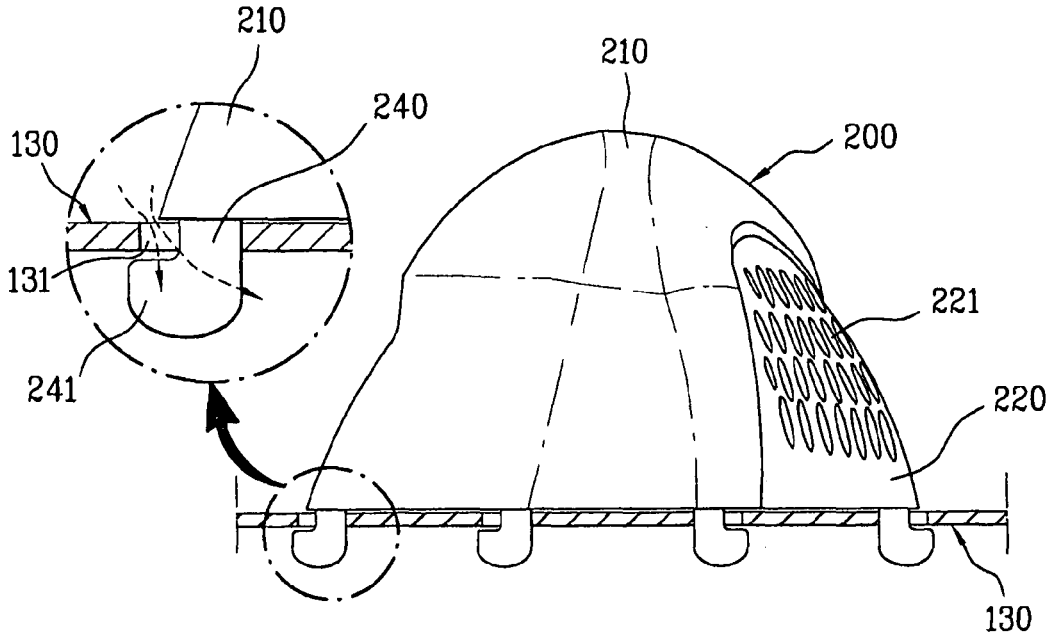
FIG. 6 and FIG. 7 are detailed views showing a coupling part of the lifter according to the embodiment of the present invention.
Figure 7:
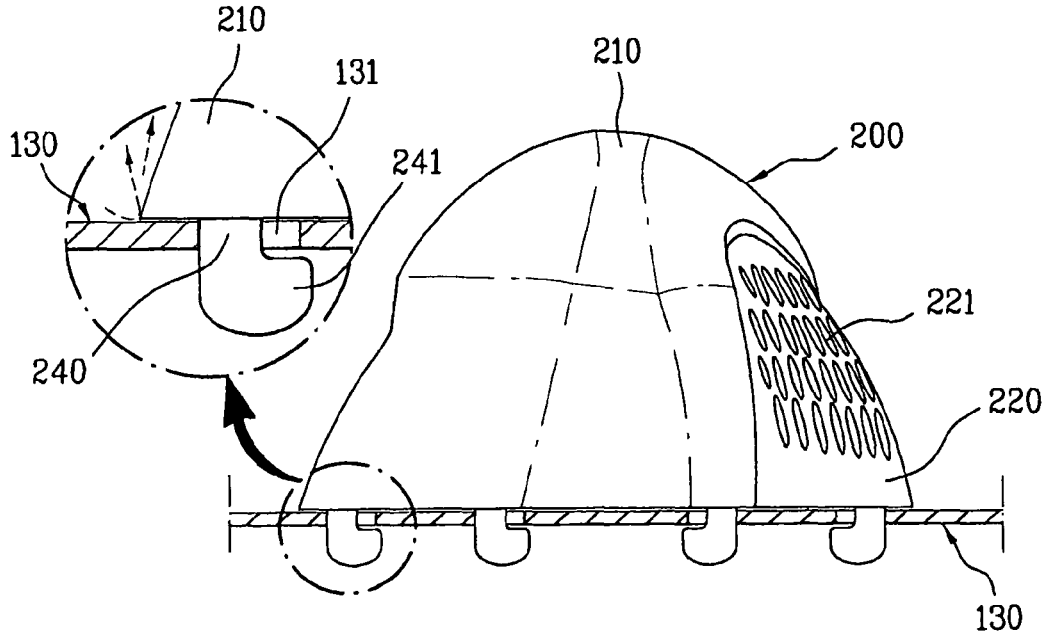

As aforementioned, the coupling part 240 may be implemented by a hook engaged with the hole 131 formed at the drum 130, which is now shown in FIG. 6 and FIG. 7. The hook may comprise a hook body extended vertically and inserted in the hole 131, and a hooking end 241 bent horizontally from the hook body to latch on a wall of the drum 130.

Generally, the hole 131 of the drum 130 is formed greater than the coupling part 240 to avoid interference with the hooking end 241. Therefore, if the hooking end 241 is protruded outward from the lifter 200 as shown in FIG. 6, the hole 131 may be partially exposed beyond the outer profile of the lifter 200. Such an exposed hole 131 could allow the washing water to flow out of the drum 130 through the exposed part of the hole 131. Therefore, the hooking end 241 could be directed to the inside of the lifter 200 as shown in FIG. 7 so that the hole 131 is not exposed out of the lifter 200, and thus prevents the washing water from leaking out through the hole 131.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a housing;

a tub provided in the housing and holding washing water therein;

a drum rotatably mounted in the tub and receiving laundry therein; and a lifter mounted to an inner surface of the drum to lift the laundry while rotating along with the drum, wherein each side of the lifter is formed to have a nonlinear shape, the lifter is oriented such that a centerline thereof forms a predetermined angle with respect to a rotational axis of the drum, and lateral sides of the lifter have protrusions bulged outwardly from inside of the lifter.

2. The washing machine according to claim 1, wherein the centerline of the lifter is pivoted about a center of the lifter by the predetermined angle from the rotational axis of the drum.

3. The washing machine according to claim 1, wherein each side of the lifter has a streamline shape.

4. The washing machine according to claim 1, wherein the protrusions of the lifter are formed partially on a lateral side of the lifter.

5. The washing machine according to claim 4, wherein the protrusions of the lifter comprise a convex-curved surface overall.

6. The washing machine according to claim 4, wherein a section of the protrusions of the lifter has an airfoil shape.

7. The washing machine according to claim 1, wherein the liter has shapes which are reverse to each other with respect to the center line.

8. The washing machine according to claim 1, wherein a shape of the lifter is symmetrical about a center of the lifter.

9. The washing machine according to claim 1, wherein one lateral side of the lifter has a reversed shape to the other lateral side.

10. The washing machine according to claim 1, wherein the lifter comprises a lifter body, and first and second protrusions bulged outwardly on the left and right sides of the lifter body.

11. The washing machine according to claim 10, wherein the first and the second protrusions each comprise a curved surface entirely.

12. The washing machine according to claim 10, wherein sections of the first and the second protrusions each has an airfoil shape.

13. The washing machine according to claim 10, wherein the first and the second protrusions are arranged alternatively on the right and left sides of the lifter body.

14. The washing machine according to claim 10, wherein the first and the second protrusions has reversed shapes to each other with respect to the centerline.

15. The washing machine according to claim 10, wherein the first and second protrusions are in a point symmetry with regard to a center of the lifter.

16. The washing machine according to claim 10, wherein the first protrusion is extended from a first end of the lifter toward a second end disposed opposite to the first end, and the second protrusion is extended from the second end toward the first end.

17. The washing machine according to claim 10, wherein the first and the second protrusions each have a plurality of dimples.

18. The washing machine according to claim 10, wherein the first and the second protrusions each have a plurality of protrusions.

19. The washing machine according to claim 10, wherein the lifter comprises a guide surface disposed adjacent to each upper part of the first and the second protrusions and inclined toward an inside of the lifter.

20. The washing machine according to claim 19, wherein the guide surface is continuously formed from each upper edge of the first and the second protrusions.

21. The washing machine according to claim 10, wherein the lifter comprises a channel formed adjacent to the each upper part of the first and the second protrusions and guiding the washing water.

22. The washing machine according to claim 1, wherein the lifter comprises a plurality of coupling parts disposed at a lower end thereof and engaged with the drum, and the coupling parts are oriented all in different directions.

23. The washing machine according to claim 22, wherein each of the coupling parts has the same orientation as an adjacent outer profile of the lifter.

24. The washing machine according to claim 22, wherein the coupling part includes a hooking end extended inwardly to be hooked on the drum.

25. The washing machine according to claim 1, wherein the lifter comprises a plurality of drain holes formed at an upper end thereof and arranged along the centerline.

* * * * *